US007694851B2

(12) United States Patent
Lompech et al.

(10) Patent No.: US 7,694,851 B2
(45) Date of Patent: Apr. 13, 2010

(54) DEVICE FOR TAMPER PROTECTING AND AUTHENTICATING A LIQUID PRODUCT DISTRIBUTOR

(75) Inventors: Herve Lompech, Bouttencourt (FR); Jean-Luc Octau, Intraville (FR)

(73) Assignee: Rexam Dispensing Systems S.A.S. (FR)

( * ) Notice: Subject to any disclaimer, the term of this patent is extended or adjusted under 35 U.S.C. 154(b) by 534 days.

(21) Appl. No.: 11/627,199

(22) Filed: Jan. 25, 2007

(65) Prior Publication Data

US 2007/0175924 A1 Aug. 2, 2007

Related U.S. Application Data

(63) Continuation of application No. PCT/FR2005/001788, filed on Jul. 11, 2005.

(30) Foreign Application Priority Data

Aug. 6, 2004 (FR) ..... 04 08695

(51) Int. Cl.
*B67D 7/06* (2010.01)

(52) U.S. Cl. ..... 222/23; 222/321.1; 222/153.09; 222/153.13; 220/214

(58) Field of Classification Search ..... 222/321.1, 222/23, 147, 153.09, 153.13; 215/258; 220/214
See application file for complete search history.

(56) References Cited

U.S. PATENT DOCUMENTS

| | | | | |
|---|---|---|---|---|
| 599,156 | A * | 2/1898 | Thompson | 215/258 |
| 3,129,854 | A * | 4/1964 | Boehm et al. | 222/321.9 |
| 4,386,696 | A * | 6/1983 | Goncalves | 215/258 |
| 2003/0109068 | A1 * | 6/2003 | Garcia et al. | 438/1 |
| 2008/0164286 | A1 * | 7/2008 | Garcia et al. | 222/321.7 |

FOREIGN PATENT DOCUMENTS

FR 2 776 991 10/1999

OTHER PUBLICATIONS

International Search Report, Nov. 17, 2005; 2 pages.

* cited by examiner

*Primary Examiner*—Kevin P Shaver
*Assistant Examiner*—Jonathan Wood
(74) *Attorney, Agent, or Firm*—St. Onge Steward Johnston & Reens LLC

(57) ABSTRACT

A device for tamper protecting and authenticating a liquid product distributor including a container with a cylindrical neck with a seal engaged therein, further including an indicator element with a collar which is elastically inwardly collapsible and whose largest diameter is greater that the neck internal diameter and which is removably disposed on the lower part of the seal and is trapped in the container after a forced penetration through the neck. The indicator element includes a sleeve in which the lower part of the seal is radially clamped.

8 Claims, 4 Drawing Sheets

DEVICE FOR TAMPER PROTECTING AND AUTHENTICATING A LIQUID PRODUCT DISTRIBUTOR

CROSS-REFERENCE TO RELATED APPLICATIONS

The present application is a continuation of pending International patent application PCT/FR2005/001788 filed on Jul. 11, 2005 which designates the United States and claims priority from French patent application 0408695 filed on Aug. 6, 2004, the content of which is incorporated herein by reference.

FIELD OF THE INVENTION

The present invention relates to a device for tamper-proofing and authenticating a liquid dispenser.

BACKGROUND OF THE INVENTION

Such a dispenser generally comprises a liquid reservoir provided with a cylindrical neck into which closure or stopper means are engaged.

More precisely, the invention relates to a device that enables the consumer to determine easily whether a dispenser and the packaged liquid that it contains are authentic and to check that the dispenser has not been tampered with, degraded, or recycled.

Devices of this type already exist whose function is to serve as media for electronic systems (chips, transmitters, etc.) that guarantee the traceability of the dispenser and/or of the liquid.

Unfortunately, those devices are held stationary by being fastened permanently to one of the component elements of the dispenser.

In addition, those devices do not make it possible to see directly the presence of damaged portions or marks resulting from an attempt to break open the dispenser, and that is detrimental to the consumer or to the vendor.

An object of the present invention is to solve those technical problems satisfactorily.

SUMMARY OF THE INVENTION

The invention achieves this object by means of a device constituted by a control element provided with a collar that is elastically foldable inwards and whose largest diameter is greater than the inside diameter of the neck and that is disposed removably at the bottom of said closure means while being trapped in said reservoir after it has been inserted by force through said neck.

In a first variant, said control element comprises a bushing inside which the bottom portion of the closure means is radially clamped.

According to an advantageous characteristic, the inside wall of said bushing carries an axial keying rib co-operating with a groove carried by the closure means.

Preferably, said bushing is provided with a peripheral skirt forming a stiffener and disposed under the collar so as to prevent any downward flexion.

In another variant, said closure means are constituted by a pump body.

According to another characteristic, said control element is formed integrally with the pump body.

According to yet another characteristic, said collar is frustoconical and flares away from the axis of the neck and upwards.

In another variant, said control element supports a traceability system.

In another variant, said collar is constituted by a series of radial fins.

In yet another variant, said control element fits the outside profile of said closure means.

The device of the invention makes it possible to offer the consumer clear evidence of whether or not the structural integrity of the distributor is intact.

Any attempt to remove the closure means from the neck automatically causes the control element to be dropped into and trapped inside the liquid reservoir.

In addition, mounting the control element is a simple assembly operation that can be easily automated and integrated into the method of manufacturing the closure means themselves which are then delivered as pre-equipped, or that can be implemented subsequently during packaging of the liquid.

The device of the invention applies to any type of closure or stopper means having a portion that extends inside the liquid reservoir and that is suitable for supporting the control element. Such closure means are, for example, pre-compression pumps that are fitted, screwed, snap-fastened, or crimped to a reservoir neck.

The device of the invention is particularly suitable for use in combating counterfeiting or infringement, or in controlling parallel imports, and can, for example, be combined with electronic systems for conventionally detecting and authenticating or tracing products by coding, or else be associated with laser marking, or indeed provided with an ink release system.

BRIEF DESCRIPTION OF THE DRAWINGS

The invention will be better understood on reading the following description given with reference to the accompanying drawings, in which.

DETAILED DESCRIPTION OF THE INVENTION

Figure 1A:
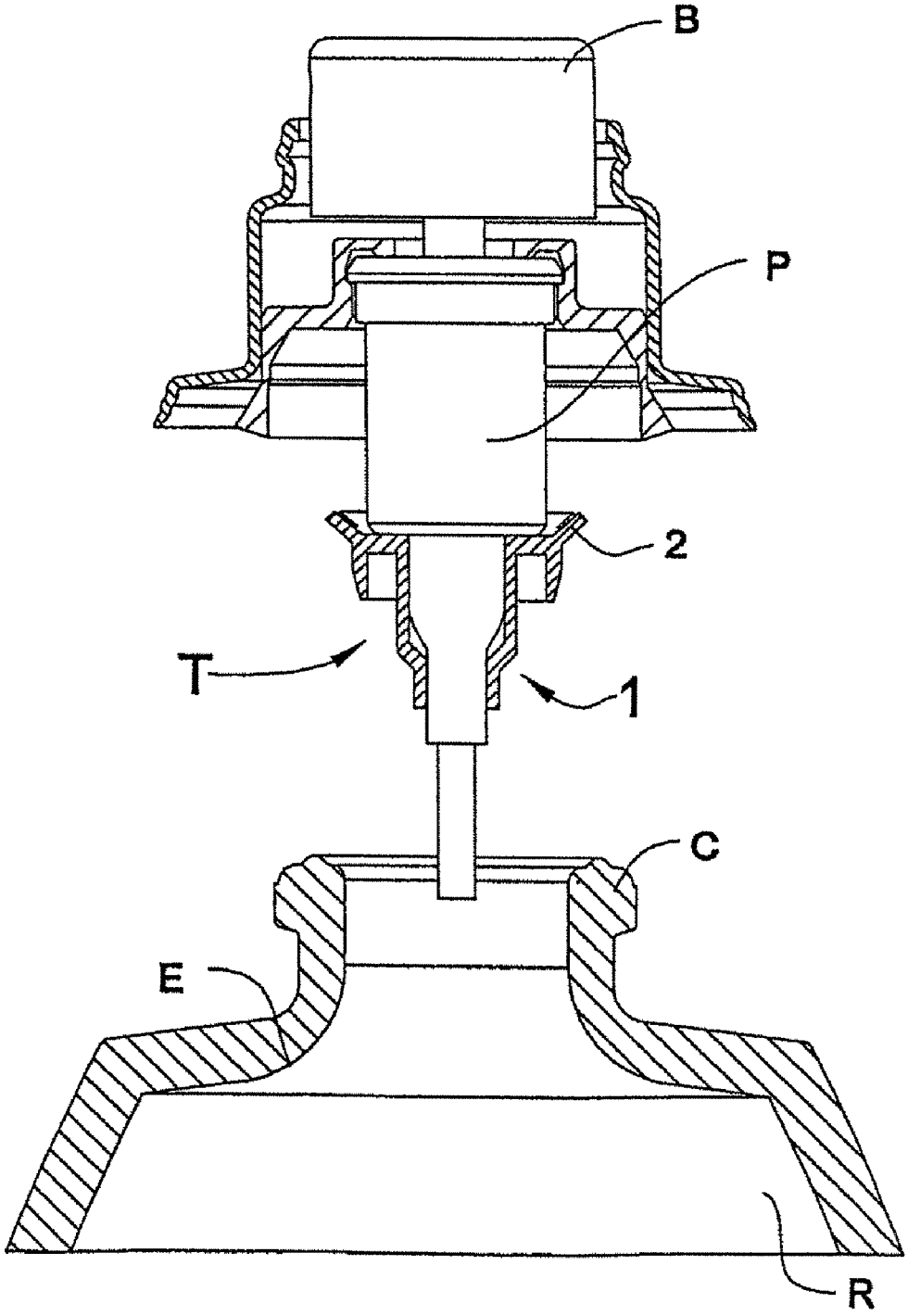
FIGS. 1A to 1C are profile views that are partially in section showing a first embodiment of the device of the invention during the assembly stage and during the tamper indicator drop stage.
Figure 1B:
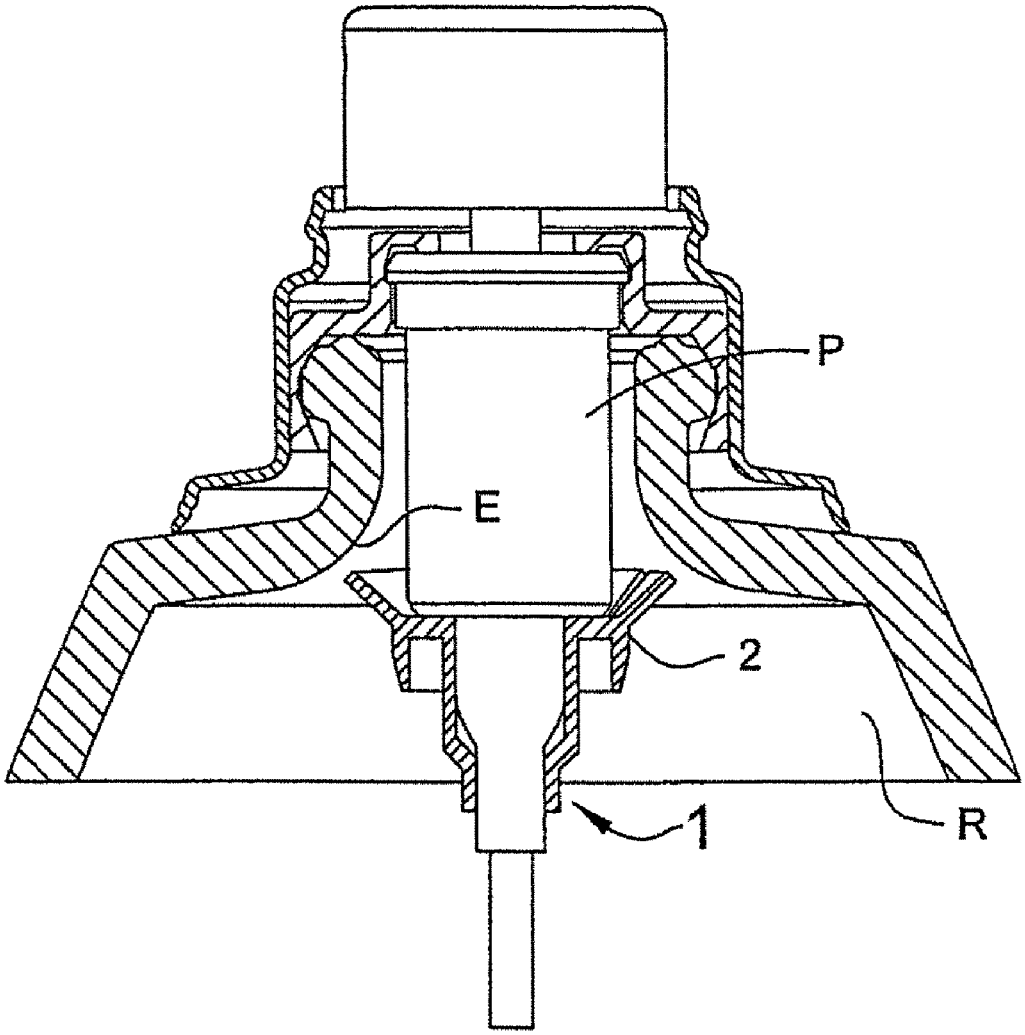
Figure 1C:
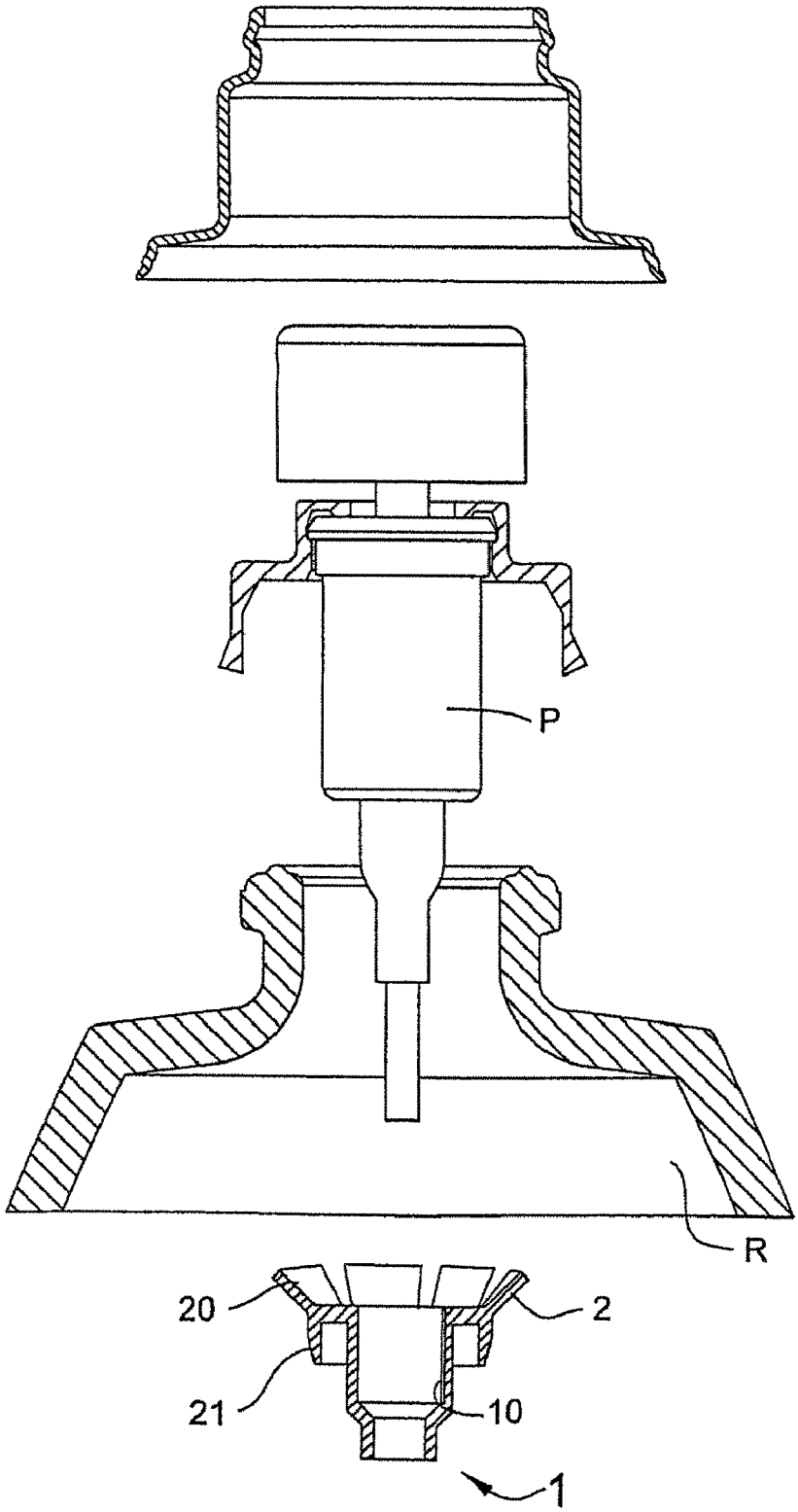

FIGS. 1A to 1C show a conventional dispenser comprising a liquid reservoir R provided with a cylindrical neck C into which there are engaged closure or stopper means, such as, in this example, a pump body P, providing the function of stopper while also enclosing a chamber and a compression mechanism capped by a push button B.

The invention makes provision to add a control element T to the closure means such that, when an attempt is made to break open the dispenser, by applying forced traction to the pump P, said control element is separated from said means and remains trapped in the reservoir R, without it being possible for said control element to be removed there from manually or using conventional means.

The presence in the reservoir of the disunited control element then constitutes evidence that the dispenser has been tampered with, and that information can be used by the vendor or by the consumer in order to discard or to refuse the product.

In FIGS. 1A to 1C, the control element T of the invention comprises a cylindrical and frustoconical bushing 1 that is designed to be mounted on the bottom portion of the pump body P in removable manner, with a small amount of radial clamping.

Preferably, the bushing 1 fits the outside profile of the pump body P.

The bushing 1 is provided with a collar 2 that extends substantially radially and peripherally. Said collar 2 is elastically deformable in one direction only towards the axis of the neck C and its largest diameter is greater than the inside diameter of said neck.

In the variant shown in FIG. 1C, the collar 2 is made up of a series of radial fins 20, or else, in another variant (not shown), said collar is made up of a continuous annular web connected to the periphery of the bushing via a peripheral link zone.

The frustoconical profile of the collar flares away from the axis of the neck and upwards, thereby preventing any downward flexion.

In this example, the bushing 1 is provided with a peripheral skirt 21 (FIG. 1C) which is disposed under the collar 2, while forming a stiffener and preventing said collar from flexing downwards.

Optionally, the bushing 1 carries a keying rib that cooperates with a corresponding groove provided in the closure means, i.e. in the body P, in this example, so as to ensure that the control element T is positioned suitably on the closure means.

Firstly, the control element 1 is mounted on the body of the pump P as shown in FIG. 1A, and then the resulting assembly is inserted by force into the neck, thereby causing the collar 2 to fold up inwards against the side wall of the body.

Therefore, once it has passed through the neck, the collar 2 is deployed and resumes it initial shape and angular position, as shown in FIG. 1B, and it then finds itself prevented from moving in axial translation by being brought into abutment under the neck C against the internal shoulder E of the reservoir R.

If someone attempts to extract the pump from the neck, the forced traction applied to the body while the collar is retained inside the reservoir, under its shoulder, causes the bushing 1 to slide downwards along the body, and then causes the control element T to be separated and to fall into the reservoir, as shown in FIG. 1C. The presence of the element T either in the liquid, or at the bottom of the reservoir thus subsequently indicates that the dispenser has been tampered with, and that the liquid has possibly been polluted or degraded.

This anomaly can be observed with the naked eye by the consumer through the translucent or transparent wall of the reservoir, or detected by the vendor by using suitable detection systems.

Figure 2:
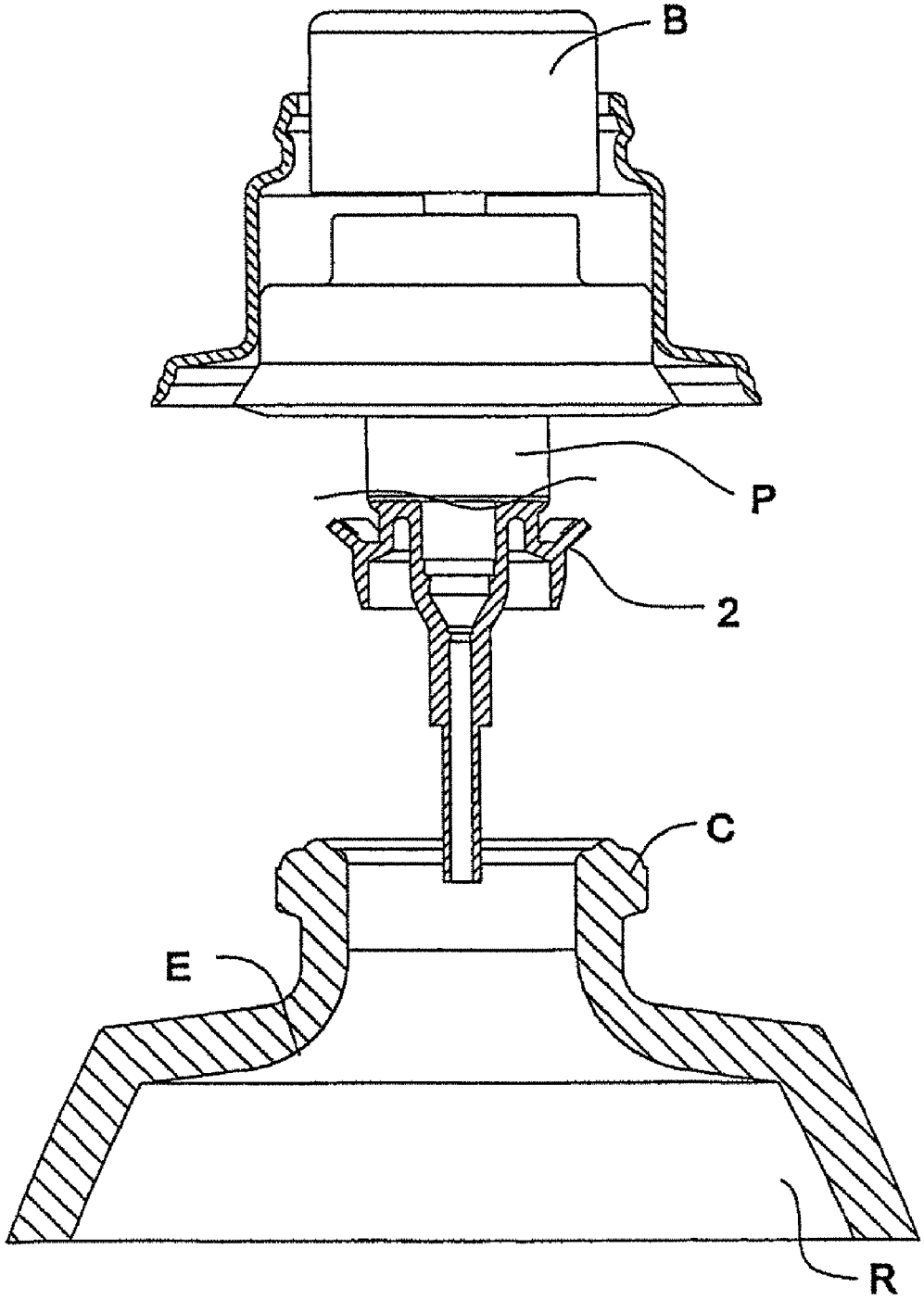
FIG. 2 is a profile view that is partially in section showing a second embodiment of the device of the invention.

FIG. 2 shows another embodiment of the control element, in which the collar 2 is molded integrally with the pump body P forming, on its own, the means both for closing and for tamper-proofing the neck in the manner of a stopper pump.

In which case, when a break-open attempt is made, it is the body itself that falls into the flask, thereby releasing the mechanism of the pump which then becomes unusable.

The authentication system can be either directly integrated into the wall of the body or else fastened to all or part of said body situated inside the flask.

What is claimed is:

1. A device for tamper-proofing and authenticating a liquid dispenser comprising a reservoir provided with a cylindrical neck into which closure means are engaged, said device being characterized in that it is constituted by a control element provided with a collar that is elastically foldable inwards and whose largest diameter is greater than the inside diameter of the neck and that is disposed removably at the bottom of said closure means while being trapped in said reservoir after it has been inserted by force through said neck, further characterized in that said control element comprises a bushing inside which the bottom portion of the closure means is radially clamped, said closure means extending through said bushing, and said bushing being provided with a peripheral skirt forming a stiffener and disposed under the collar preventing said collar from flexing downward.

2. A device according to claim 1, characterized in that the inside wall of said bushing carries an axial keying rib cooperating with a groove carried by the closure means.

3. A device according to claim 1, characterized in that said closure means are constituted by a pump body.

4. A device according to claim 1, characterized in that said collar is frustoconical and flares away from the axis of the neck and upwards.

5. A device according to claim 1, characterized in that said control element includes a traceability system.

6. A device according to claim 1, characterized in that said collar is constituted by a series of radial fins.

7. A device according to claim 1, characterized in that said control element fits the outside profile of said closure means.

8. A device for tamper-proofing and authenticating a liquid dispenser comprising a reservoir provided with a cylindrical neck into which closure means are engaged, said device being characterized in that it is constituted by a control element provided with a collar that is elastically foldable inwards and whose largest diameter is greater than the inside diameter of the neck and that is disposed removably at the bottom of said closure means while being trapped in said reservoir after it has been inserted by force through said neck, further characterized in that said control element comprises a bushing inside which the bottom portion of the closure means is radially clamped, said bushing being provided with a peripheral skirt forming a stiffener and disposed under the collar preventing said collar from flexing downward, wherein said closure means are constituted by a pump body and said control element is formed integrally with the pump body.

* * * * *